US007869723B2

(12) United States Patent
Koinuma

(10) Patent No.: US 7,869,723 B2
(45) Date of Patent: Jan. 11, 2011

(54) IMAGE FORMING APPARATUS CAPABLE OF FORMING GLOSSY COLOR IMAGE

(75) Inventor: Nobuyuki Koinuma, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 289 days.

(21) Appl. No.: 11/945,029

(22) Filed: Nov. 26, 2007

(65) Prior Publication Data

US 2008/0124099 A1 May 29, 2008

(30) Foreign Application Priority Data

Nov. 27, 2006 (JP) ..... 2006-319094

(51) Int. Cl.
*G03G 15/01* (2006.01)
*G03G 15/20* (2006.01)

(52) U.S. Cl. ..... 399/40; 399/342

(58) Field of Classification Search ..... 399/40, 399/45, 82, 85, 322, 342, 400, 407
See application file for complete search history.

(56) References Cited

U.S. PATENT DOCUMENTS

| | | | | |
|---|---|---|---|---|
| 4,975,748 | A | 12/1990 | Koinuma et al. | |
| 5,003,354 | A | 3/1991 | Takamiya et al. | |
| 5,016,114 | A | 5/1991 | Sakata et al. | |
| 5,270,783 | A | 12/1993 | Bisaiji et al. | |
| 5,848,321 | A | 12/1998 | Roh et al. | |
| 6,108,022 | A * | 8/2000 | Landman et al. | 347/228 |
| 6,236,815 | B1 * | 5/2001 | Kaneko et al. | 399/45 |
| 7,450,278 | B2 * | 11/2008 | Nakazawa | 358/504 |
| 2005/0152706 | A1 * | 7/2005 | Koie et al. | 399/15 |
| 2006/0239729 | A1 | 10/2006 | Okamoto | |
| 2007/0164505 | A1 | 7/2007 | Ishibashi et al. | |

FOREIGN PATENT DOCUMENTS

| | | |
|---|---|---|
| CN | 1165330 A | 11/1997 |
| JP | 7-325511 | 12/1995 |
| JP | 10-86562 | 4/1998 |
| JP | 10-307507 | 11/1998 |
| JP | 11-243486 | 9/1999 |
| JP | 2001-100468 | 4/2001 |
| JP | 2004-191678 | 7/2004 |
| JP | 3994688 | 8/2007 |

OTHER PUBLICATIONS

U.S. Appl. No. 11/649,204, filed Jan. 4, 2007, Mikio Ishibashi, et al.

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

An image forming apparatus includes an image forming unit and a correction unit. The image forming unit superimposes toner images of a plurality of colors, one over the other, on a recording medium to form a composite color toner image thereon. The correction unit corrects an image condition of the toner images of the plurality of colors when the composite color toner image is formed on a transparent portion of the recording medium so as to be visible from a side opposite a side on which the composite color toner image is formed.

10 Claims, 7 Drawing Sheets

IMAGE FORMING APPARATUS CAPABLE OF FORMING GLOSSY COLOR IMAGE

CROSS-REFERENCE TO RELATED APPLICATIONS

This patent specification is based on Japanese patent application No. JP 2006-319094 filed on Nov. 27, 2006 in the Japan Patent Office, the entire contents of which are incorporated by reference herein.

BACKGROUND OF THE INVENTION

1. Field of the Invention

The present invention relates to an image forming apparatus, and more particularly to an image forming apparatus capable of forming a glossy color image of photographic quality.

2. Discussion of the Background

For an image forming apparatus used as a copier, facsimile, printer, plotter, or multi-functional device thereof, various attempts have been and are being made to obtain a glossy color image of photographic quality.

For example, a conventional image forming apparatus includes an intermediate transfer member onto which a plurality of toner images of different colors are transferred in a superimposing manner from at least one photoconductor, a transparent-toner developing unit that develops an image with a specific transparent toner to form a transparent toner image, a second transfer member that transfers the color toner image and the transparent toner image formed on the intermediate transfer member onto a transfer material, and a fixing member that fixes the color toner image and the transparent toner image on the transfer material.

The conventional image forming apparatus uses a specific transparent toner to obtain a highly glossy image. When the color toner image is formed on the transfer material in the usual manner, the conventional image forming apparatus forms the transparent toner image over an entire surface of the transfer material before the transfer material is conveyed to the fixing unit. The fixing unit fixes the color toner image and the transparent toner image on the transfer material, thus producing a glossy photographic image.

However, for the conventional image forming apparatus, the fixing unit may be subjected to a relatively heavy load because the transparent toner is applied over the entire surface of the transfer material, and differences in toner thickness occur between image formation areas and non-image formation areas of the transfer material.

In another conventional technique, a specific recording medium may be used to obtain a glossy image. Such specific recording medium has a thermoplastic layer on at least one face thereof. When an image is fixed on the recording medium in the usual manner, heat and pressure are further applied to the image on the recording medium to obtain a glossy photographic image.

However, the recording medium may need to be used together with a specific fixing device to provide such a glossy photographic image. Therefore, this technique may have disadvantages in terms of configuration, cost, and power consumption.

SUMMARY OF THE INVENTION

In light of the above-described situation, exemplary embodiments of the present invention provide an image forming apparatus capable of forming a glossy photographic image in a relatively simple configuration.

In one exemplary embodiment of the present invention, an image forming apparatus includes an image forming unit and a correction unit. The image forming unit superimposes toner images of a plurality of colors, one over the other, on a recording medium to form a composite color toner image thereon. The correction unit corrects an image condition of the toner images of the plurality of colors when the composite color toner image is formed on a transparent portion of the recording medium so as to be visible from a side opposite a side on which the composite color toner image is formed.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 3A to 3C illustrate a process of forming a mirror image of an original image on a recording medium including a transparent portion and a non-transparent portion, in which FIG. 3A is a plan view of an original image on a source document, FIG. 3B is a plan view of the composite recording medium having a mirror image of the original image of FIG. 3A, and FIG. 3C is a perspective view illustrating a folded state of the composite recording medium of FIG. 3B;

Figure 1:
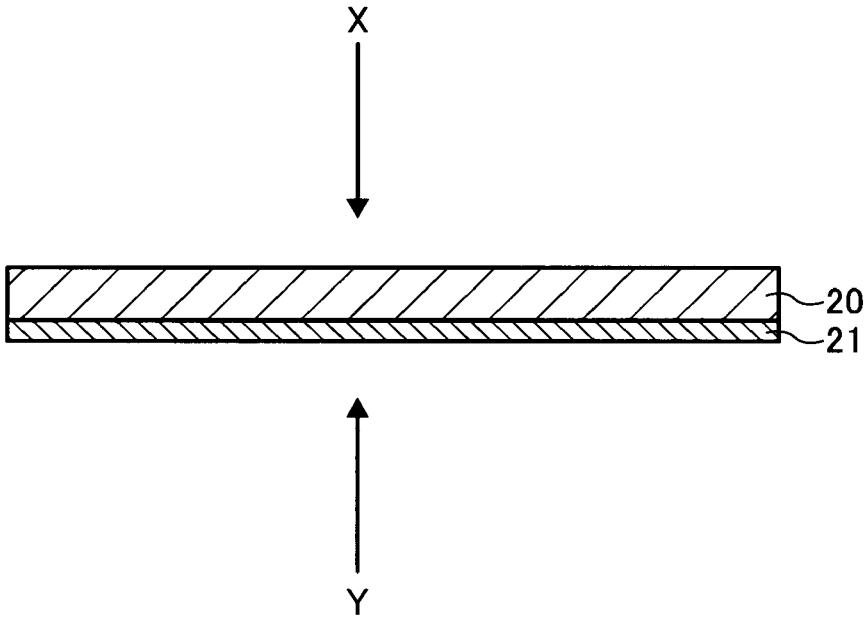
FIG. 1 is a sectional view of an OHP sheet having a color toner image on one side thereof.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner. For the sake of simplicity, the same reference numerals are used in the drawings and the descriptions for the same materials and constituent parts having the same functions, and descriptions thereof are omitted unless otherwise stated.

Example embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and descriptions thereof are omitted.

When a color toner image formed on a transparent recording medium made of, for example, polyester, is viewed from the opposite side of an image formation side thereof (hereinafter "observation side"), a glossy, photographic image quality may be obtained. Because the transparent recording medium has a glossy surface, the color toner image formed thereon may be observed as a glossy photographic image. In such a case, however, the color tone of the color toner image may be changed by the transparent recording medium. Specifically, a color of the toner formed in an uppermost layer on the observation side, i.e., a lowermost layer on the image formation side may be emphasized, resulting in a difference in color tone between an original image and a reproduced color toner image.

Table 1 illustrates color differences in red, green, and blue colors between values obtained when a toner image 21 is directly measured by a spectrocolorimeter and values obtained when the toner image 21 is measured by the spectrocolorimeter through a transparent sheet 20. The transparent sheet 20 is a commercially-available plastic sheet for an OHP (over head projector). The color toner image 21 is formed on one face of the transparent sheet 20 by an image forming apparatus described later.

As illustrated in FIG. 1, the toner image 21 is directly measured by the spectrocolorimeter from a direction indicated by an arrow Y in FIG. 1. Measurements thus obtained are collectively referred to as "OHP front" values. Further, the toner image 21 is measured by the spectrocolorimeter through the transparent sheet 20 from a direction indicated by an arrow X in FIG. 1. Measurements thus obtained are collectively referred to as "OHP back" values. By subtracting the OHP back values from the OHP front values, respective color differences in red, green, and blue colors are obtained as listed in the column "OHP front-back" of Table 1.

Figure 2:
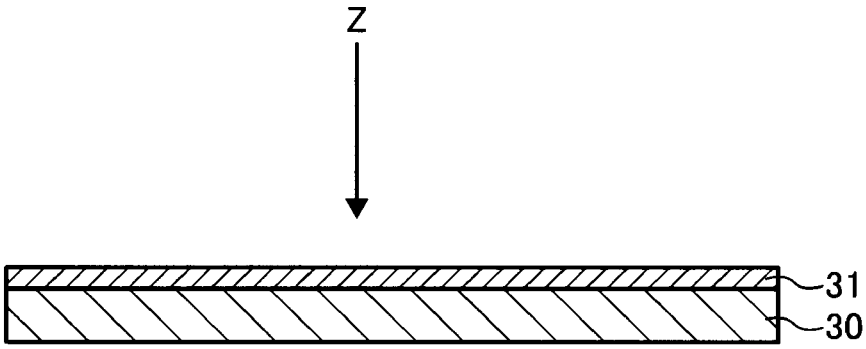
FIG. 2 is a sectional view of a paper sheet having a color toner image on one side thereof.

Further, with the same image conditions, as illustrated in FIG. 2, a color toner image 31 is formed on one face of a commercially available paper sheet 30 by the image forming apparatus. The color toner image 31 is measured by the spectrocolorimeter from a direction indicated by an arrow Z in FIG. 2. Measurements thus obtained are collectively referred to as "paper sheet" values. By subtracting the paper sheet values from the corresponding OHP front values or OHP back values, respective color differences are obtained as listed in the column "OHP front-paper sheet" or "OHP back-paper sheet", respectively, of Table. 1.

TABLE 1

| COLOR | OHP front-back | OHP front-paper sheet | OHP back-paper sheet |
|---|---|---|---|
| Red | 6.57 | 3.69 | 6.68 |
| Green | 2.59 | 6.89 | 7.12 |
| Blue | 8.03 | 6.93 | 12.57 |

As illustrated in Table 1, a color tone may be different between when the toner image 21 is directly viewed ("OHP front") and when the toner image 21 is viewed through the transparent OHP sheet 20 ("OHP back"). Further, relatively greater color differences may be observed between the OHP front face and the OHP back face ("OHP front-back") compared to those observed between the OHP front face and the paper sheet ("OHP front-paper sheet").

In Table 1, regarding comparisons with the toner image formed on the paper sheet, relatively large differences in the respective colors are observed between the OHP back face and the paper sheet ("OHP back-paper sheet") compared to those observed between the OHP front face and the paper sheet ("OHP front-paper sheet"). Consequently, a relatively large difference in color tone may occur between the original image and the toner image on the paper sheet. Thus, for a toner image formed on one face of a transparent sheet, a difference in color tone may be observed between when the toner image is directly viewed from the image formation side and when the toner image is viewed through the transparent sheet from the observation side.

Preferably, such a difference in color tone is corrected to accurately reproduce the original image. Hence, when forming a color toner image to be viewed through a transparent sheet, an image forming apparatus, described later, according to an exemplary embodiment performs tone correction in developing an electrostatic latent image carried on a photoconductor with toner. For example, with respect to Table 1, the image forming apparatus may perform tone correction on a color toner image so that the "OHP back" face and the "paper sheet" have a similar, if not identical, tone.

The image forming apparatus includes a correction circuit and a software program to correct image conditions so that a color toner image to be viewed thorough a transparent sheet may have a similar, if not the same, tone as that of a reference color toner image formed on a plain paper sheet or the like.

Specifically, based on the reference color toner image formed on the plain paper sheet or the like, the correction circuit may execute the software program to correct brightness, contrast, chroma saturation, grey balance of a desired color toner image to be formed on a transparent sheet. Thus, when viewed thorough the transparent sheet, the desired color toner image has a similar, if not the same, color tone as the reference color toner image.

Such tone correction may be performed as follows. First, a toner image of a reference pattern is formed on each of a transparent OHP sheet and a paper sheet, and then the toner image is scanned by a scanner and input to the image forming apparatus as image data. Such image data is processed by a software program so that the images formed on the transparent OHP sheet and the paper sheet may have a given level of color tone value (hereinafter preset color tone value), which may be set in advance. Such preset color tone value may be stored in a lookup table. When forming a toner image on a transparent sheet, a controller may read such preset tone value from the lookup table and use such preset tone value to correct a color tone of toner image formed on a transparent sheet.

Such software program may be a computer-readable printer-profile program, which may be used to correct brightness, contrast, chroma saturation, and gray balance of colors of red, green, and blue of an image based on a target chart prepared for the program or a reference toner image formed on a paper sheet, so that a color toner image viewed thorough a transparent sheet may have a color tone, which is similar, if not the same, as the reference color image.

Further, such tone correction may also be performed for a printer or plotter that is not provided with a scanner, by preparing a color tone profile based on an image detection result of a colorimeter.

When a toner image formed on a transparent sheet is viewed through the transparent sheet, the toner image is observed as a mirror image, i.e., a horizontally reversed image of an original image. Therefore, in forming the toner image, a mirror image is preferably formed on the transparent sheet.

Figure 3:
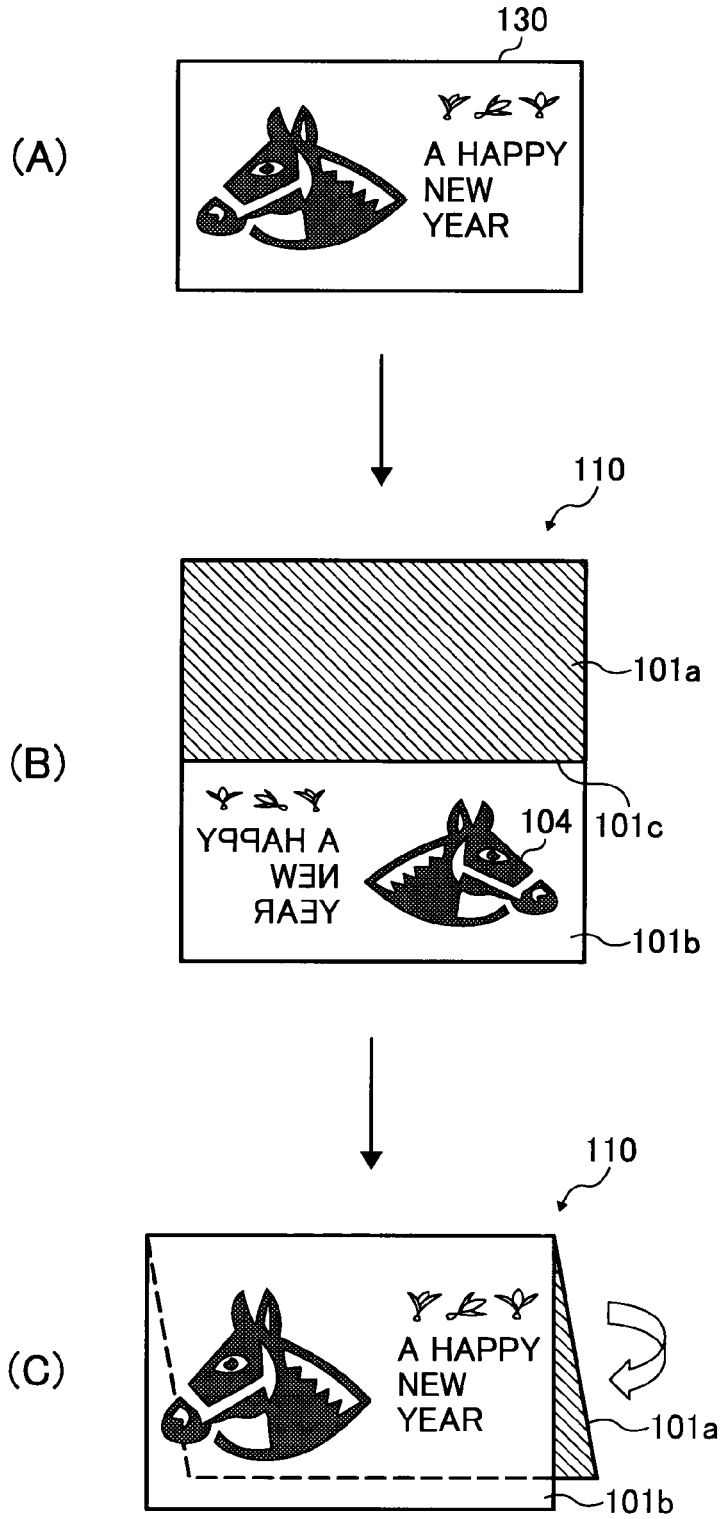

An illustration of a source document 130 as illustrated in FIG. 3A is formed on a recording medium 110 according to an electrophotographic method. As illustrated in FIG. 3B, the recording medium 110 may include a non-transparent portion 101*a* in one half thereof and a transparent portion 101*b* in the other half. The non-transparent portion 101*a* has a thermosensitive adhesive layer 102 on a back face thereof. An original image of the source document 130 is horizontally reversed into a mirror image thereof, and, as illustrated in FIG. 3B, a color toner image 104 is formed on the transparent portion 101*b* of the recording medium 110 as the mirror image.

The recording medium 110 can be folded along a border 101*c* as illustrated in FIG. 3C.

Figure 4:
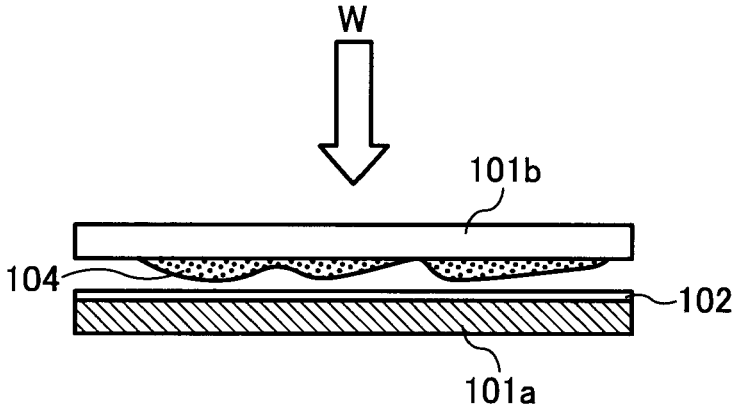
FIG. 4 is a sectional view of a composite recording medium having a color toner image formed thereon.

As illustrated in FIG. 4, the transparent portion 101*b* and the non-transparent portion 101*a* are bonded together with a thermosensitive adhesive layer 102, which may be coated on the non-transparent portion 101*a*, so as to sandwich the color toner image 104 between them. When the recording medium 110 thus formed is viewed from a direction indicated by an arrow W in FIG. 4, the color toner image 104 is observed as a normal image having an illustration identical to that of the source document 130.

Figure 5:
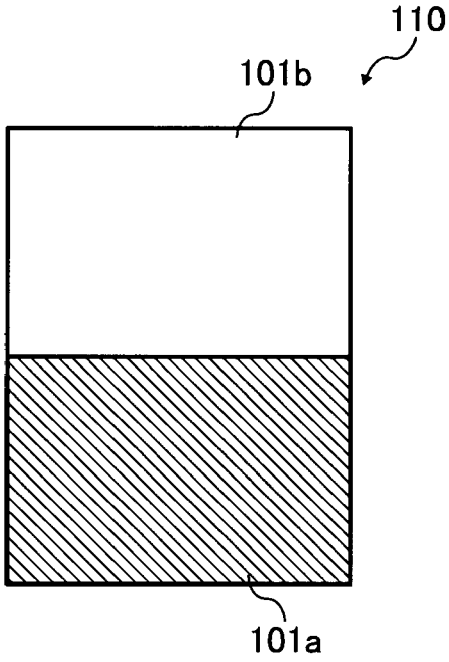
FIG. 5 is a plan view of a composite recording medium useable in an image forming apparatus according to an exemplary embodiment.
Figure 6:
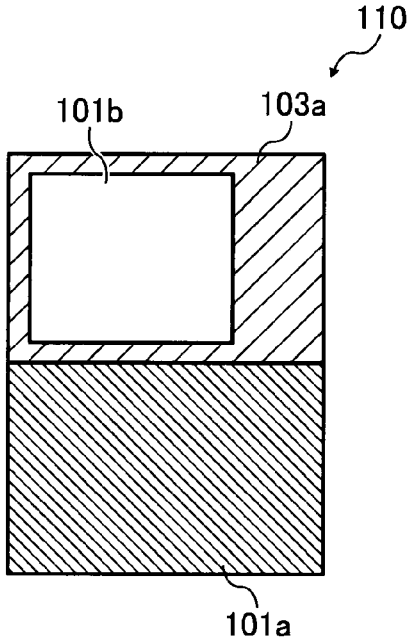
FIG. 6 is a plan view of a composite recording medium useable in an image forming apparatus according to an exemplary embodiment.
Figure 7:
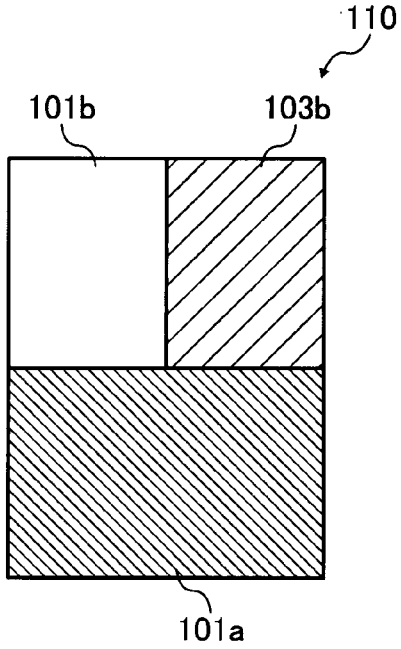
FIG. 7 is a plan view of a composite recording medium useable in an image forming apparatus according to an exemplary embodiment.

As illustrated in FIG. 5, the recording medium 110 may include a transparent portion 101*b* and a non-transparent sheet 101*a*. Alternatively, as illustrated in FIG. 6 or 7, the recording medium 110 may further include a non-transparent frame 103*a* or a shield section 103*b* in the transparent portion 101*b*.

Alternatively, the recording medium 110 may be entirely formed of a transparent portion 101*b*. In such a configuration, when an image forming apparatus forms a color toner image on one face of the recording medium 110, a paper sheet having a given color, for example white, may be laminated on an image forming face thereof.

Alternatively, a thermosensitive adhesive layer 102 may be formed on a transparent portion 101*b* rather than a non-transparent portion 101*a* and a color toner image 104 may be formed on the thermosensitive adhesive layer 102. In such a case, the thermosensitive adhesive layer 102 is preferably formed of transparent material.

Further, without using such a thermosensitive adhesive layer, the transparent portion 101*b* and/or the non-transparent portion 101*a* may be formed of a thermoplastic member so that the transparent portion 101*b* and the non-transparent portion 101*a* are directly bonded together by applying heat and pressure thereto.

Next, an image forming apparatus according to an exemplary embodiment is described with reference to FIG. 8.

Figure 8:
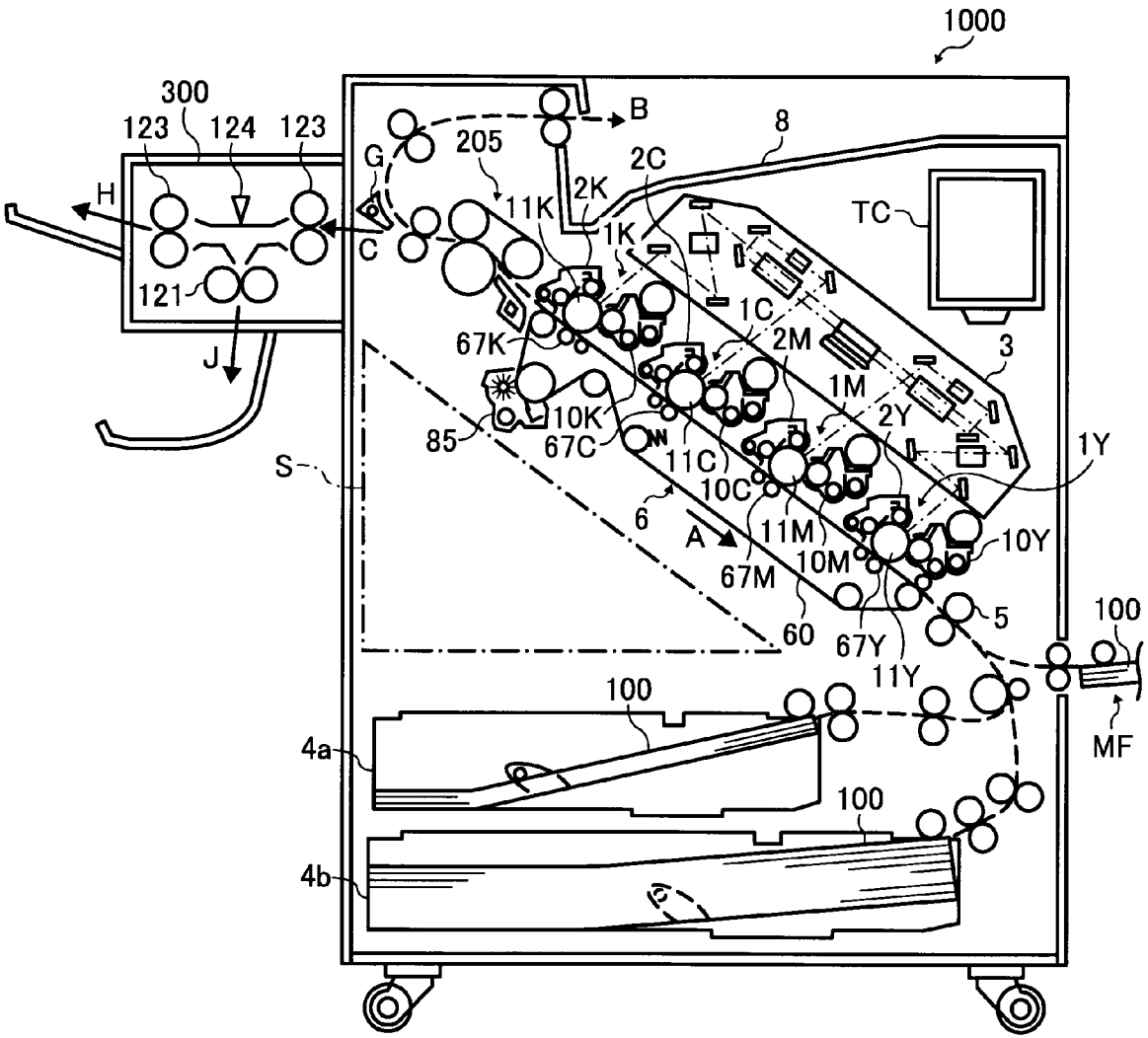
FIG. 8 is a schematic view illustrating a configuration of an image forming apparatus according to an exemplary embodiment.

FIG. 8 is a schematic view illustrating a configuration of a full-color electrophotographic image forming apparatus 1000 according to an exemplary embodiment. As illustrated in FIG. 8, the image forming apparatus 1000 may include four image forming units 1Y, 1M, 1C, and 1K to form images of yellow, magenta, cyan, and black, respectively. It should be noted that the color order is not limited to the order of Y, M, C, and K illustrated in FIG. 8, but may be any other order.

The image forming units 1Y, 1M, 1C, and 1K include developing devices 10Y, 10M, 10C, and 10K and photoconductor drums 11Y, 11M, 11C, and 11K, respectively. Further, each of the image forming units includes a charger and a cleaner. The image forming units 1Y, 1M, 1C, and 1K are arranged at a given pitch along a transfer-sheet conveyance direction so that the rotation axes of the photoconductor drums 11Y, 11M, 11C, and 11K are parallel to each other.

Above the image forming units 1Y, 1M, 1C, and 1K is disposed an optical writing unit 3 including a light source, a polygon mirror, a f-θ lens, and a reflection mirror. The optical writing unit 3 irradiates a laser beam based on image data while scanning each surface of the photoconductor drums 11Y, 11M, 11C, and 11K.

Below the image forming units 1Y, 1M, 1C, and 1K is disposed a transfer unit 6 serving as a belt driving device. The transfer unit 6 includes a transfer conveyance belt 60 to carry and convey a transfer sheet 100 so as to pass through respective transfer sections of the image forming units 1Y, 1M, 1C, and 1K.

A cleaning unit 85 is disposed in contact with an outer surface of the transfer conveyance belt 60. The cleaning unit 85 may include a brush roller and a cleaning blade to remove foreign matter such as residual toner remaining on the transfer conveyance belt 60.

Above the transfer unit 6 are disposed a fixing unit 205, an ejection tray 8, and a toner supply container TC. In a lower portion of the image forming apparatus 1000 are provided sheet feeding cassettes 4*a* and 4*b*. On a lateral side of the image forming apparatus 1000 is provided a manual feed tray MF to manually feed a transfer sheet 100 or any other suitable recording medium. Further, waste toner bottles, a duplex printing unit, and a power source may be provided in a space S indicated by a dot-and-dash line in FIG. 8. The developing devices 10Y, 10M, 10C, and 10K have similar configurations except for differences in toner color and employ an identical two-component development method. Each of the developing devices 10Y, 10M, 10C, and 10K accommodates a developer including toner and magnetic carrier.

Each of the developing devices 10Y, 10M, 10C, and 10K may include a developing roller opposed to each of the photoconductor drums 11Y, 11M, 11C, and 11K, a screw for conveying and agitating the developer, and a toner density sensor. The developing roller includes a rotatable sleeve on an outer side thereof and a magnet fixed on an inner side thereof. In response to an output of the toner density sensor, a toner supply unit supplies toner to the developing roller.

For example, in the image forming unit 1Y, when a given voltage is applied from a power supply to a charging roller, the charging roller charges a surface of the photoconductor drum 11Y opposed to the charging roller. Based on image data, the optical writing unit 3 directs a laser beam onto the surface of the photoconductor drum 11Y having been charged with a given electric potential to form an electrostatic latent image thereon. When the electrostatic latent image on the surface of the photoconductor drum 11Y reaches the developing device 10Y, the developing roller opposed to the photoconductor drum 11Y supplies toner to the electrostatic latent image on the surface of the photoconductor drum 11Y to form a toner image thereon.

In each of the photoconductor units 2Y, 2M, 2C, and 2K, the above-described operation is performed at a given timing in a similar manner. Thus, toner images of the respective colors are formed on the surfaces of the photoconductor drums 11Y, 11M, 11C, and 11K.

A transfer sheet 100 may be fed from any one of the sheet feeding cassettes 4*a* and 4*b*, and the manual feed tray MF. On reaching registration rollers 5, the transfer sheet 100 is temporarily stopped. Then, the registration rollers 5 forward the transfer sheet 100 at a timing suitable for the image forming operations of the photoconductor units 2Y, 2M, 2C, and 2K.

While the transfer sheet 100 is conveyed by the transfer conveyance belt 60, the respective toner images on the photoconductor drums 11Y, 11M, 11C, and 11K are sequentially transferred onto the transfer sheet 100.

Meanwhile, a power supply applies a voltage having a polarity opposite that of toners on the photoconductor drums 11Y, 11M, 11C, and 11K to primary transfer rollers 67Y, 67M, 67C, and 67K. As illustrated in FIG. 8, the primary transfer rollers 67Y, 67M, 67C, and 67K are disposed opposite the photoconductor drums 11Y, 11M, 11C, and 11K, respectively, across the transfer conveyance belt 60. In response to the application of the voltage, the toner images on the photoconductor drums 11Y, 11M, 11C, and 11K are transferred to the transfer sheet 100.

When the transfer sheet 100 passes through a transfer section between the photoconductor drum 11K and primary transfer roller 67K, the toner images of the four colors are superimposed one on top of another on the transfer sheet 100. The transfer sheet 100 having the toner images of the four colors formed thereon is conveyed to the fixing device 205. The fixing device 205 applies heat and pressure to fix the toner images on the transfer sheet 100. The transfer sheet 100 is further forwarded by conveyance rollers in a direction indicated by an arrow B and is ejected to the ejection tray 8.

As described above, the image forming apparatus 1000 according to the present exemplary embodiment is capable of forming an image on a commercially available non-transparent paper sheet like the transfer sheet 100. The image forming apparatus 1000 is also capable of forming an image on a transparent sheet made of polyester or other suitable material. Further, the image forming apparatus 1000 is capable of forming an image on a recording medium including a transparent portion and a non-transparent portion. In such a case, the image forming apparatus 1000 is capable of forming a color tone image on the transparent portion of the recording medium and folding the recording medium so as to sandwich the color toner image between the non-transparent portion and the transparent portion.

The image forming apparatus 1000 may use the recording medium 110 including the transparent portion 101*b* in one half and the non-transparent portion 101*a* in the other half as illustrated in FIGS. 3B and 3C. In such a case, as described above, the image forming apparatus 1000 forms a color toner image 104 as a mirror image of an original image on the transparent portion 101*b*. Further, the image forming apparatus 1000 folds the recording medium 110 back along a border 101*c* between the non-transparent portion 101*a* and the transparent portion 101*b* so as to bond the two portions 101*a* and 101*b* together, so that the color toner image 104 is visible through the transparent portion 101*b*.

Figure 9:
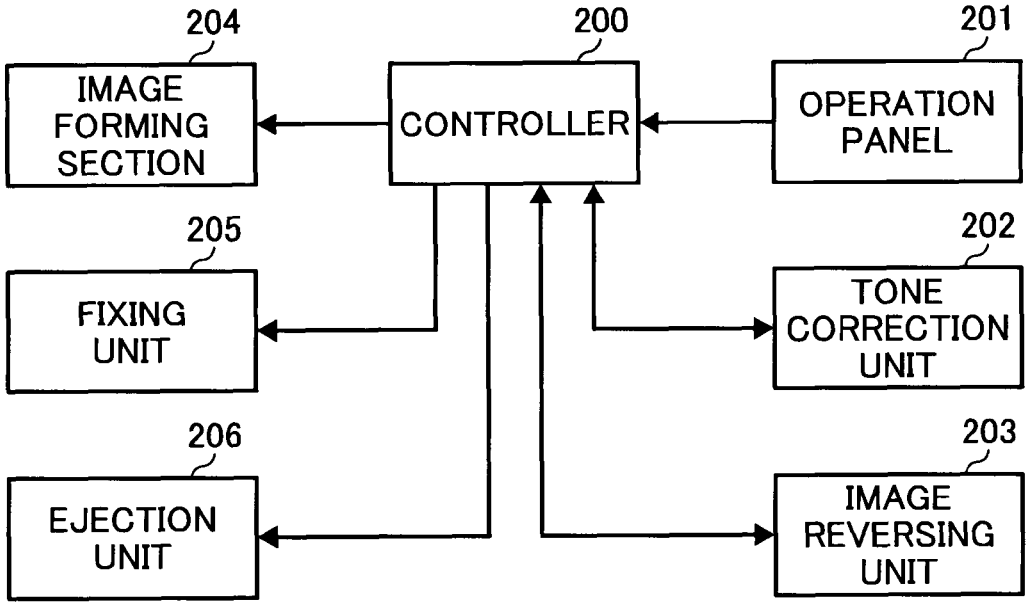
FIG. 9 is a block diagram illustrating a tone correction unit and an image reversing unit of an image forming apparatus according to an exemplary embodiment.

As illustrated in FIG. 9, in the image forming apparatus 1000, a controller 200 receives an operation instruction from an operation panel 201, for example, a signal instructing it to form an image on the back side of the transparent portion 101*b*, and sends a tone correction instruction to a tone correction unit 202. The tone correction unit 202 includes the above-described tone correction circuit and serves as a correcting unit. Based on the tone correction instruction, the tone correction unit 202 executes appropriate correction processing in the manner described above, that is, the controller 200 causes an image forming section 204 to form a color toner image having a corrected tone on a transparent portion 101*b* of a recording medium 110, which is fed from the manual feed tray MF, for example. Further, the controller 200 causes a fixing unit 205 and an ejection unit 206 to fix the color toner image on the recording medium 110 and eject the recording medium 110, respectively.

Alternatively, in the image forming apparatus 1000, when receiving, from the operation panel 201, an instruction for forming a mirror toner image on the back side of a transparent portion 101*b* of a recording medium 110, the controller 200 instructs an image reversing unit 203 to generate a mirror image, i.e., a horizontally reversed image of an original image. The controller 200 causes the tone correction unit 202 to execute tone correction processing as described above on the mirror image. The controller 200 also activates the image forming section 204 to form a color toner image having a corrected tone as the mirror image on the transparent portion 101*b* of the recording medium 110. Further, the controller 200 causes the fixing device 205 and the ejection device 206 to perform the fixing and ejecting operations described above.

When the color toner image is fixed on the transparent portion 101*b* of the recording medium 110 by the fixing device 205, a path switching member G changes the conveyance path of the recording medium 110 in a direction indicated by an arrow C in FIG. 8. Thus, the recording medium 110 is conveyed to a post-processing device 300.

Figure 10:
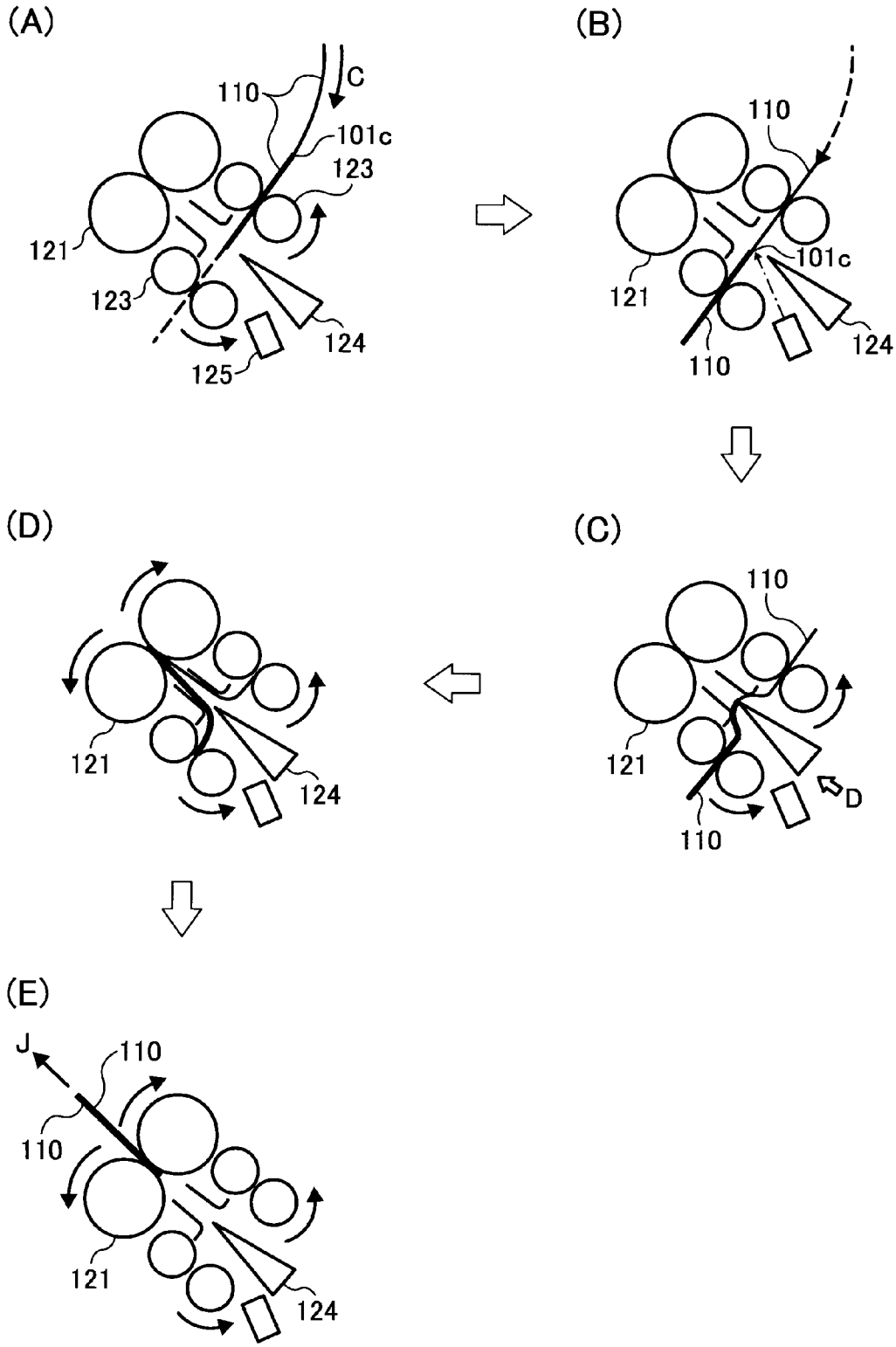
FIGS. 10A to 10E illustrate an operation of a post-processing device of an image forming apparatus according to an exemplary embodiment.

The post-processing device 300 bonds the non-transparent portion 101*a* to the transparent portion 101*b* having the toner image. FIGS. 10A to 10E illustrate a procedure of this bonding operation. As illustrated in FIG. 10A, the recording medium 110 having been subjected to the fixing process is conveyed from a direction indicated by the arrow C to a conveyance roller pair 123. The conveyance roller pair 123 further forwards the recording medium 110.

As illustrated in FIG. 10B, when a sensor 125 detects a border 101*c* between the non-transparent portion 101*a* and the transparent portion 101*b*, the conveyance roller pair 123 stops forwarding the recording medium 110.

As illustrated in FIG. 10C, by protruding a folding claw 124 serving as a folding member in a direction indicated by an arrow D, the recording medium 110 is folded along the border 101*c* between the non-transparent portion 101*a* and the transparent portion 101*b*.

As illustrated in FIG. 10D, by further protruding the folding claw 124, the recording medium 110 is also further folded and thus a folded edge thereof is inserted between heat-and-pressure rollers 121.

When the folded edge is conveyed between the heat-and-pressure rollers 121, the heat-and-pressure rollers 121, serving as pressing members, start to be rotated so as to apply heat and pressure to the folded recording medium 110. Thereby, the non-transparent portion 101*a* and the transparent portion 101*b* are bonded together and the recording medium 110 is ejected in a direction indicated by an arrow J of FIG. 8 and FIG. 10E. The recording medium 110 thus produced has a sectional configuration as illustrated in FIG. 4.

Alternatively, when a transparent recording medium is not subjected to the above-described bonding operation of the post-processing device 300, the recording medium is ejected in a direction indicated by an arrow H in FIG. 8.

In another exemplary embodiment, the post-processing device 300 includes a spray coating unit or a roller coating unit to apply white paint to the surface of a toner image formed on a transparent sheet medium so that the toner image is clearly visible from the front side of the transparent sheet medium.

As described above, when forming a color toner image on a transparent portion of a recording medium, the image forming apparatus 1000 according to the present exemplary embodiment performs tone correction on toner images of a plurality of colors using the tone correction circuit and forms a composite color toner image on a back side of the transparent portion. Accordingly, the color toner image having an appropriate tone can be viewed from the front side of the transparent portion of the recording medium. Thus, an excellent photographic image can be readily and reliably obtained.

Further, the image forming apparatus also includes the image reversing unit for reversing an original image to generate a mirror image thereof. As a result, when a color toner image is viewed from the front side of a transparent portion of a recording medium, a normal image similar to the original image can be observed. Thus, when outputting a photographic image, a user can obtain a mirror image by conducting the reversing processing without separately preparing the mirror image, thereby reducing the time and effort in forming the photographic image.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus, comprising:

an image forming unit to superimpose toner images of a plurality of colors, one over the other, on a transparent portion of a recording medium to form a composite color toner image thereon;

a correction unit to correct an image condition of the toner images of the plurality of colors to have substantially the same image condition of toner images of the plurality of colors of a reference color toner image formed on a paper sheet, when the composite color toner image formed on the transparent portion of the recording medium is formed to be visible from a side opposite a side on which the composite color toner image is formed; and wherein the correction unit corrects the image condition based on preset tone values of the reference color toner image stored in a lookup table.

2. The image forming apparatus according to claim 1, further comprising:

an image reversing unit to reverse an original image to form a mirror image of the original image, wherein the image forming unit forms the composite color toner image as the mirror image on the transparent portion of the recording medium.

3. The image forming apparatus according to claim 1, further comprising:

a folding member to fold the recording medium having the composite color toner image on the transparent portion thereof along a border between the transparent portion and a non-transparent portion of the recording medium so as to encase the composite color toner image between the transparent portion and the non-transparent portion; and a pressing member to apply pressure and heat to the recording medium folded by the folding member so as to bond the transparent portion and the non-transparent portion thereof together.

4. The image forming apparatus according to claim 1, wherein the correction unit is a processor that corrects the image condition by executing a computer-executable program.

5. The image forming apparatus according to claim 1, wherein the preset tone values are determined by comparing the reference color toner image formed on a transparent medium with the reference color toner image formed on the paper sheet.

6. A method for forming a composite color image on a recording medium, the method comprising:

superimposing toner images of a plurality of colors, one over the other, on a transparent portion of the recording medium to form the composite color toner image thereon;

correcting an image condition of the toner images of the plurality of colors to have substantially the same image condition of toner images of the plurality of colors of a reference color toner image formed on a paper sheet, when the composite color toner image formed on the transparent portion of the recording medium is formed to be visible from a side opposite a side on which the color composite image is formed; and wherein the correcting is based on preset tone values of the reference toner image stored in a lookup table.

7. The method according to claim 6, further comprising:

reversing an original image to form a mirror image of the original image, wherein the image forming unit forms the composite color toner image as the mirror image on the transparent portion of the recording medium.

8. The method according to claim 6, further comprising:

folding the recording medium having the composite color toner image on the transparent portion thereof along a border between the transparent portion and a non-transparent portion of the recording medium so as to encase the composite color toner image between the transparent portion and the non-transparent portion; and applying pressure and heat to the recording medium folded by the folding so as to bond the transparent portion and the non-transparent portion thereof together.

9. The method according to claim 6, wherein the correcting includes executing a computer-executable program.

10. The method according to claim 6, wherein the preset tone values are determined by comparing the reference color toner image formed on a transparent medium with the reference color toner image formed on the paper sheet.

* * * * *